United States Patent [19]

Pincham

[11] Patent Number: 4,644,590

[45] Date of Patent: Feb. 24, 1987

[54] HALO SHIRT

[76] Inventor: Wilma I. Pincham, 14548 Yelm Hwy. SE., Yelm, Wash. 98597

[21] Appl. No.: 830,047

[22] Filed: Feb. 18, 1986

[51] Int. Cl.[4] ..... A41B 1/00

[52] U.S. Cl. ..... 2/115

[58] Field of Search ..... 2/115, 114, DIG. 7, 2/106, 77; 223/111

[56] References Cited

U.S. PATENT DOCUMENTS

| | | | |
|---|---|---|---|
| 302,901 | 8/1884 | Fenne | 2/114 |
| 695,496 | 3/1902 | Schermerhorn | 2/114 |
| 818,351 | 4/1906 | Clark | 2/114 |
| 1,766,272 | 6/1930 | Vallier | 2/114 |
| 1,810,363 | 6/1931 | Malapeta | 223/111 |
| 2,494,496 | 1/1950 | Taylor | 2/115 |
| 2,497,764 | 2/1950 | Doughty | 2/114 |
| 2,607,041 | 8/1952 | Williamson | 2/122 |
| 3,618,139 | 11/1971 | Hugin | 2/115 |

FOREIGN PATENT DOCUMENTS

| | | | |
|---|---|---|---|
| 23779 | of 1893 | United Kingdom | 2/114 |

*Primary Examiner*—Doris L. Troutman

*Attorney, Agent, or Firm*—Henderson & Sturm

[57] ABSTRACT

A garment apparatus (10) for use in combination with a halo apparatus (200); wherein said garment apparatus (10) comprises a front opening garment unit (11) having an elongated lateral front opening (50) and an elongated lateral back opening (60) which accommodate the vertical support arms (202) of the halo apparatus (200).

6 Claims, 4 Drawing Figures

FIG. 1.
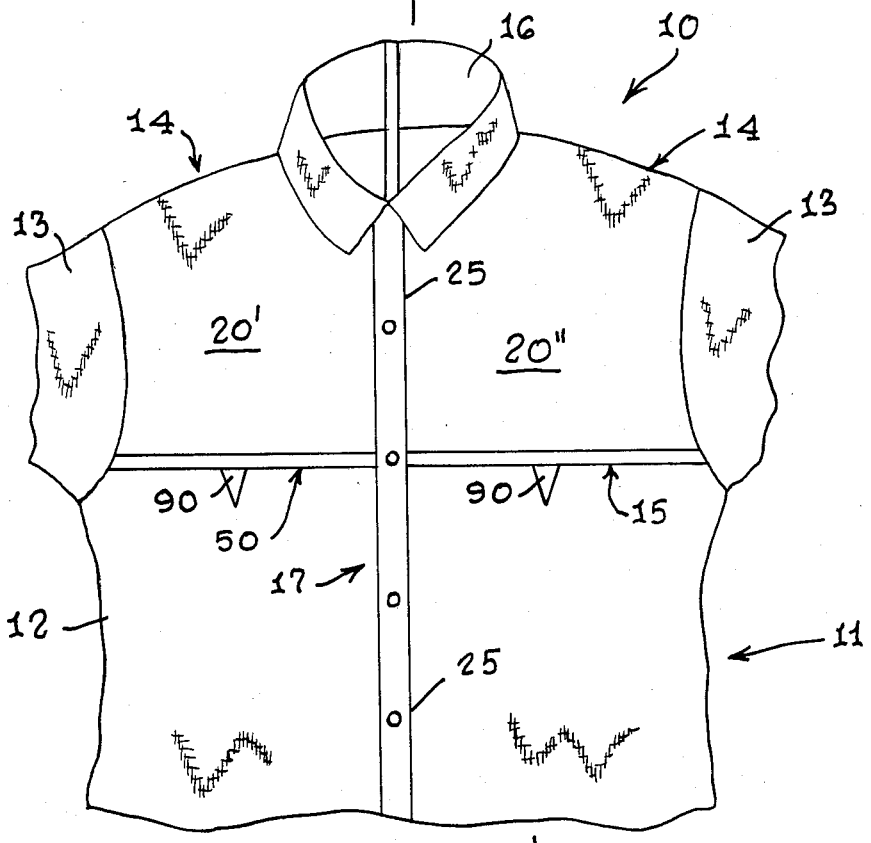
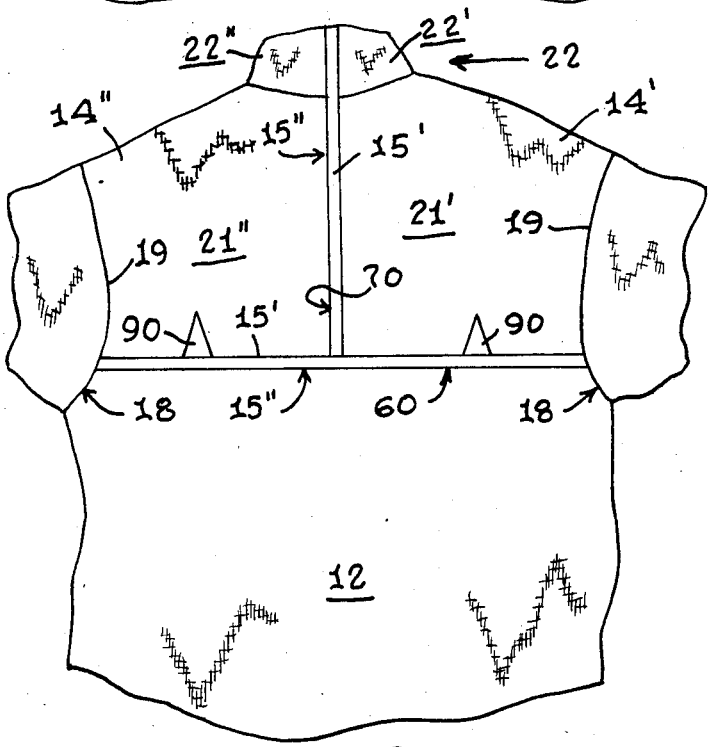
FIG. 2.

FIG. 3.
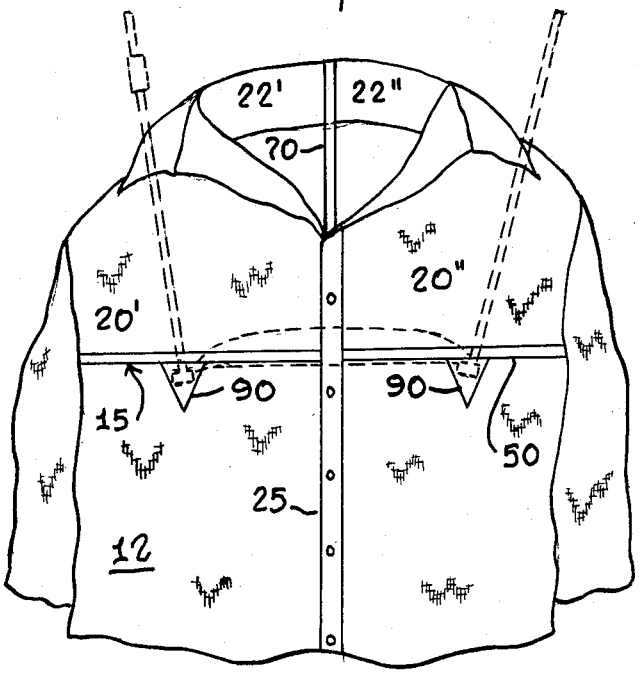
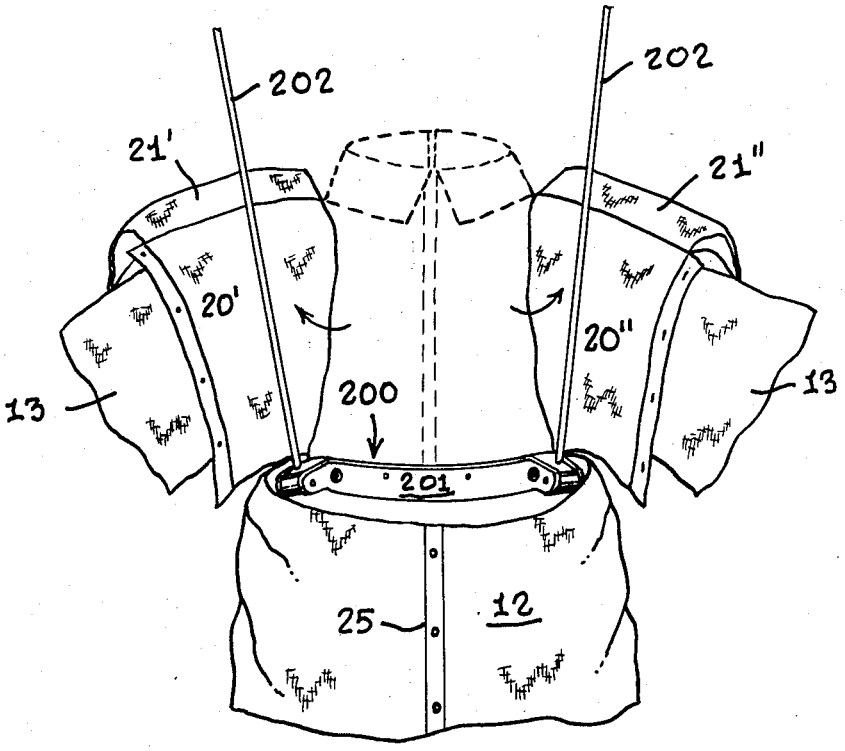
FIG. 4.

HALO SHIRT

TECHNICAL FIELD

The present invention relates generally to the field of specialized shirt constructions.

BACKGROUND OF THE INVENTION

The prior art is replete with detachable panel shirt and hospital gown constructions, as is evidenced by the following U.S. Pat. Nos: 302,901; 2,497,764; 3,618,139; 2,494,496; 2,607,041; and 818,351.

While each of the aforementioned prior art constructions were developed to perform specific functions, these functions can be categorized broadly as user convenient functions or as second party convenient functions.

With respect to the user convenient functions these specialized constructions are designed primarily for the personal comfort and convenience of the user with respect to the donning or doffing of the apparel, and even to the selective removal or addition of specific garment panels to accommodate different climatic conditions.

With respect to the second party convenient functions, these specialized constructions are designed to facilitate the covering or disrobing of a physically incapacitated or infirm individuals by another party during a hospital stay, or at home during the users recuperative period.

Unfortunately, due to the specialized construction of all of the known prior art devices, a small but significant number of individuals have been totally ignored with respect to their own unique needs. These individuals comprise those people who were fortunate enough to survive a broken neck; and yet are required as a result of their injury to be confined for a period of time in a body cast and halo apparatus.

For the purpose of explanation to those individuals not familiar with a halo apparatus, this apparatus normally comprises a body attached framework secured to the users upper torso and provided with a plurality of upwardly extending arms which rigidly support a cranial support and immobilization device.

In order to provide the degree of support, immobilization and restraint necessary to prevent further injury to the users spinal column, and to promote the mending of the fractured vertebra; the arms of the halo apparatus are spaced as far apart as possible on the users torso, and further project upwardly and outwardly with respect to their point of attachment to the torso connected framework.

Up until the present time given the bulky nature and specialized construction of the typical halo apparatus, it was virtually impossible for someone wearing a halo apparatus to wear normal apparel given the large openings required to accommodate the span between the support arms. In as much as most users are required to wear a halo apparatus for an extended period of time; this situation virtually condemned them to suffer with respect to their sartorial appearance, until such time as the halo apparatus could be removed.

BRIEF SUMMARY OF THE INVENTION

The present invention was developed specifically to address the problem encountered by users of a halo apparatus with respect to their ability to wear apparel having an appearance that is not markedly different from the day to day apparel worn by individuals that did not share their circumstances.

In order to accomplish this objective it was necessary to develop a garment that was specifically designed to accommodate the four widely spaced support arms of the halo apparatus; and, to do so in such a manner that the only visible alteration of the garment involved the apertures through which the support arms would of necessity have to project through.

A secondary but equally important consideration of this specialized apparel construction was the combined convenience of both the user and another party, who would be required to assist the user at least with respect to donning the garment, given the mobility restraints imposed upon the user simply by virtue of wearing a halo apparatus.

Briefly stated, the halo garment that forms the basis of this invention comprises a basic upper torso front opening garment construction, wherein the midriff and sleeve portions of the garment are basically unaltered, and the upper chest, neck, and upper back portions of the garment comprise two releasable panels whose outboard ends are fixedly secured to sleeve portions of the garment.

In addition the garment is further provided with a plurality of notches adjacent the adjoining edges of the releasable panels and the midriff encircling portion of the garment; whereby, the notches will recieve the support arms of the halo apparatus when the garment is secured together.

Given the fact that the releasable closures on the respective portions of the halo garment are of the hook and loop type commonly referred to as VELCRO fasteners, it is only necessary for the users assistant to secure the back portions of the releasable panels once the user has inserted their arms through the sleeves of the garment. Once that task has been accomplished the unaided user can complete the dressing function on their own, as well as attending to the removal of the garment without the benefit of outside assistance.

BRIEF DESCRIPTION OF THE DRAWINGS

These and other objects, advantages, and novel features of the invention will become apparent from the detailed description of the best mode for carrying out the preferred embodiment of this invention which follows; particularly when considered in conjunction with the accompanying drawings wherein:

FIG. 1 is an isolated front elevation view of a shirt embodying the teachings of this invention;

FIG. 2 is a rear elevational view of the shirt depicted in FIG. 1;

FIG. 3 is a front elevational view of the shirt of FIG. 1 being worn over a typical halo apparatus; and, FIG. 4 is a front elevational view of the shirt of FIG. 3 partially engaged with the halo apparatus.

BEST MODE FOR CARRYING OUT THE INVENTION

As can be seen by reference to the drawings and in particular to FIGS. 1 and 2, the halo garment apparatus of the present invention is designated generally by the reference numeral (10). The garment apparatus (10) comprises in general: a front opening garment unit (11) having a midriff encircling member (12) a pair of sleeve members (13); a plurality of panel members (14); and releasable closure means (15) operably connecting said panel members (14) to said midriff encircling member (12). The components of said front opening garment unit (11) will now be described in seriatim fashion.

As can best be seen by reference to FIG. 1, the front opening garment unit (11) is provided with standard fastening means (25) which extend from the garment neck opening (16) down the front of the garment unit (11) to secure the garment unit front opening (17) in a well recognized manner.

At this point it should also be noted that the pair of sleeve members (13) and the midriff encircling member (12) of the garment unit (11) are also of standard construction; and, the crux of this invention relates to the attachment and cooperation of the panel members (14) with respect to one another, and to both the midriff encircling member (12) and the sleeve members (13).

As can best be seen by reference to FIG. 2, the midriff encircling member (12) is fixedly secured to the lower portion (18) of the respective sleeve members (13); and, the plurality of panel members (14) are fixedly secured to the upper portion (19) of the respective sleeve members (13).

In the preferred embodiment of the invention illustrated in the drawings, each of the panel members (14) comprise the right hand and left hand halves (14')(14") of the upper portion of the garment unit (11). Each of the panel members (14) further comprises: an upper chest segment (20); an upper back segment (21) and a collar segment (22). In addition the opposed ends of the upper chest segments (20')(20") are provided with standard fastening means (25) whereby the garment unit front opening (17) will retain a normal appearance.

The releasable closure means (15) comprise cooperating hook and loop closure elements (15') and (15") whereby the opposed ends of the upper back segments (21')(21") and the collar segments (22')(22") may be joined together; as well as joining the lower ends of the right hand and left hand chest (20) and back (21) segments to the midriff encircling member (12).

The garment apparatus (10) heretofore described is normal in all outward respects to an unaltered garment when the releasable closure means (15) are engaged. In essence the front of the standard garment has been provided with an elongated lateral upper chest opening (50), and the back of the standard garment has been provided with both an elongated lateral upper back opening (60) and an elongated vertical back opening (70) which extends from the back of the garment neck opening (16) to the lateral upper back opening (60).

By virtue of the aforementioned arrangement, a person wearing the garment apparatus (10) of this invention can completely expose the upper chest and back portions of their torso by the releasable engagement of the panel members (14) relative to one another and the midriff encircling member (12).

It should be noted however that the garment apparatus (10) of this invention was specifically developed for use in combination with a halo apparatus (200); and to that end further modifications must be incorporated into the garment apparatus (10) thus far described.

As can best be seen by reference to FIG. 4, the halo apparatus (200) comprises a body attached harness or framework (201) having four widely spaced vertical support arms (202), which project upwardly and outwardly away from the users body; and, which are used to support a cranial immobilization and support element (not shown).

Given the fact that the support arms (202) of the halo apparatus (200) must be accommodated by the garment apparatus (10), this invention further contemplates providing the garment apparatus (10) with a plurality of widely spaced discrete notches (90) disposed along the lateral openings (50) and (60) formed in the garment apparatus. These discrete notches (90) are dimensioned to receive the support arms (202) of the halo apparatus (200); and, as shown in FIGS. 1 and 2 may optionally be disposed in either the torso encircling member (12) or on the bottoms of the respective panel members (14')(14").

At this juncture it should be appreciated that a garment apparatus (10) constructed in accordance with the teachings of this invention, will be extremely useful for individuals who are required to wear a halo apparatus; in that the garment apparatus (10) will enable the user to wear apparel that is fashionable, practical, and standard in most outward appearances.

It should also be appreciated that not only are the teachings of this invention adaptable to virtually all outerwear; but, even more significant are the functional benefits derived by the user and the individual upon whom the user is dependent for assistance while dressing.

The garment apparatus (10) of this invention not only greatly simplifies the task of dressing someone wearing a halo apparatus; but, also allows the person wearing the halo apparatus to remove the garment apparatus (10) by themselves.

In order to don the garment apparatus (10) of this invention, the user simply inserts their arms into the sleeve members (13) and then secures the midriff encircling member (12) in a well recognized manner. At this point, the user will normally require a nominal amount of assistance in securing the releasable closure means (15) disposed adjacent the lateral (60) and vertical (70) back openings. Once this point has been reached, the user may then engage the releasable closure (15) disposed adjacent the lateral (60) and vertical (70) back openings. Once this point has been reached, the user may then engage the releasable closure (15) and standard fastening (25) means on the front of the garment apparatus by themselves.

When the user wishes to remove the garment apparatus (10), all that is required is a disengagement of the standard fastening means (25), followed by a downward pull on the midriff encircling member (12) which will effect the release of the releasable closure means (15) on the front and back of the garment apparatus (10).

Having thereby described the subject matter of this invention it should be appreciated that many substitutions, modifications and variations of the invention are possible in light of the above teachings. It is therefore to be understood that the invention as taught and described herein is only to be limited to the extent of the breadth and scope of the appended claims.

I claim:

1. A garment apparatus for use in combination with a halo apparatus having a plurality of widely spaced apart support arms; wherein, the garment apparatus comprises:

a front opening garment unit having: a midriff encircling member; a pair of arm members; a plurality of panel members; and, releasable closure means operably connecting said panel members to said midriff encircling member;

wherein, said midriff encircling member is fixedly secured to the lower portions of said arm members; and, said panel members are fixedly secured to the lower portion of said arm members.

2. A garment apparatus as in claim 1; wherein, said front opening garment unit is provided with an elongated lateral front opening and an elongated lateral back opening.

3. A garment apparatus as in claim 2; wherein, said front opening garment unit is further provided with an elongated vertical back opening.

4. A garment apparatus as in claim 3; wherein, said elongated lateral openings and said elongated vertical openings are provided with releasable closure means.

5. A garment apparatus as in claim 4; wherein, said elongated lateral openings are further provided with a plurality of widely spaced discrete notches which are dimensioned to receive said plurality of support arms on said halo apparatus.

6. A garment apparatus used in combination with a halo apparatus having a plurality of widely spaced apart support arms; wherein, the garment apparatus comprises:

a front opening garment unit having an elongated lateral front opening; and, an elongated lateral back opening;

wherein, said front opening unit is further provided with a neck opening and a vertical opening extending from the back of said neck opening to said elongated lateral back opening;

wherein, said lateral openings and said vertical openings are provided with releasable closure means; and, wherein, said lateral openings are provided with widely spaced discrete notches dimensioned to accomodate said support arms on said halo apparatus.

* * * * *